US008006756B2

(12) United States Patent
Mazzanti

(10) Patent No.: US 8,006,756 B2
(45) Date of Patent: Aug. 30, 2011

(54) GAS ASSISTED DOWNHOLE PUMP

(75) Inventor: Daryl V. Mazzanti, Spring, TX (US)

(73) Assignee: Evolution Petroleum Corporation, Houston, TX (US)

( * ) Notice: Subject to any disclaimer, the term of this patent is extended or adjusted under 35 U.S.C. 154(b) by 71 days.

(21) Appl. No.: 12/001,152

(22) Filed: Dec. 10, 2007

(65) Prior Publication Data

US 2009/0145595 A1 Jun. 11, 2009

(51) Int. Cl.
*E21B 43/00* (2006.01)

(52) U.S. Cl. ..... 166/263; 166/370; 166/242.3

(58) Field of Classification Search ..... 166/263, 166/370, 313, 242.3, 268
See application file for complete search history.

(56) References Cited

U.S. PATENT DOCUMENTS 2,137,167 A * 11/1938 Lang ..... 166/269
4,951,752 A 8/1990 Coleman
5,284,208 A * 2/1994 Clemens et al. ..... 166/383
5,450,902 A * 9/1995 Matthews ..... 166/268
5,535,825 A * 7/1996 Hickerson ..... 166/302
6,039,121 A 3/2000 Kisman
6,138,758 A 10/2000 Shaw et al.
6,179,056 B1 1/2001 Smith
6,189,614 B1 * 2/2001 Brady et al. ..... 166/266
6,237,692 B1 5/2001 Averhoff
6,298,918 B1 * 10/2001 Franco et al. ..... 166/372
6,367,555 B1 * 4/2002 Senyard et al. ..... 166/370
6,382,317 B1 5/2002 Cobb
6,443,229 B1 * 9/2002 Kulka ..... 166/268
6,457,522 B1 * 10/2002 Bangash et al. ..... 166/267
7,163,063 B2 * 1/2007 Seams ..... 166/370

* cited by examiner

*Primary Examiner* — Jennifer H Gay
*Assistant Examiner* — Catherine Loikith
(74) *Attorney, Agent, or Firm* — Strasburger & Price, LLP

(57) ABSTRACT

An artificial lift system is disclosed for removing reservoir fluids from a wellbore. A downhole pump and a gas lift system are disposed in the wellbore. The gas lift system includes a first tubing string, and the downhole pump may be positioned with a second tubing string. Injected pressured gas from the gas lift system may commingle with and raise reservoir fluids from the wellbore through the first tubing string. The commingled gas and reservoir fluids may be separated in the wellbore, and the reservoir liquids may be brought to the surface through the second tubing string by the pump.

23 Claims, 6 Drawing Sheets

GAS ASSISTED DOWNHOLE PUMP

BACKGROUND OF THE INVENTION

I. Field of the Invention

The present invention relates to artificial lift production systems and methods deployed in subterranean oil and gas wells, and more particularly relates to artificial lift production systems and methods for removing wellbore liquids from directional or horizontal wellbores.

II. Background and Prior Art

Many oil and gas wells will experience liquid loading at some point in their productive lives due to the reservoir's inability to provide sufficient energy to carry wellbore liquids to the surface. The liquids that accumulate in the wellbore may cause the well to cease flowing or flow at a reduced rate. To increase or re-establish the production, operators place the well on artificial lift, which is defined as a method of removing wellbore liquids to the surface by applying a form of energy into the wellbore. Currently, the most common artificial lift systems in the oil and gas industry are down-hole pumping systems and compressed gas systems.

The most popular form of down-hole pump is the sucker rod pump. It comprises a dual ball and seat assembly, and a pump barrel containing a plunger. The plunger is lowered into a well by a string of rods contained inside a production tubing string. A pump jack at the surface provides the reciprocating motion to the rods which in turn provides the reciprocal motion to stroke the pump. As the pump strokes, fluids above the pump are gravity fed into the pump chamber and are then pumped up the production tubing and out of the wellbore to the surface facilities. The invention will also function with other downhole pump systems such as progressive cavity, jet, electric submersible pumps and others.

Compressed gas systems can be either continuous or intermittent. As their names imply, continuous systems continuously inject gas into the wellbore and intermittent systems inject gas intermittently. In both systems, compressed gas flows into the casing-tubing annulus of the well and travels down the wellbore to a gas lift valve contained in the tubing string. If the gas pressure in the casing-tubing annulus is sufficiently high compared to the pressure inside the tubing adjacent to the valve, the gas lift valve will be in the open position which subsequently allows gas in the casing-tubing annulus to enter the tubing and thus lift liquids in the tubing out of the wellbore. Continuous gas lift systems work effectively unless the reservoir has a depletion or partial depletion drive. Depletion or partial depletion drive reservoirs undergo a pressure decline as reservoir fluids are removed. When the reservoir pressure depletes to a point that the gas lift pressure causes significant back pressure on the reservoir, continuous gas lift systems become inefficient and the flow rate from the well is reduced until it is uneconomic to operate the system. Intermittent gas lift systems apply this back pressure intermittently and therefore can operate economically for longer periods of time than continuous systems. Intermittent systems are not as common as continuous systems because of the difficulties and expense of operating surface equipment on an intermittent basis.

Horizontal drilling was developed to access irregular fossil energy deposits in order to enhance recovery of hydrocarbons. Directional drilling was developed to access fossil energy deposits some distance from the surface location of the wellbore. Generally, both of these drilling methods begin with a vertical hole or well. At a certain point in this vertical well, a turn of the drilling tool is initiated which eventually brings the drilling tool into a deviated position with respect to the vertical position.

It is not practical to install most artificial lift systems in the deviated sections of directional or horizontal wells since down-hole equipment installed in these regions can undergo high maintenance costs. Therefore, most operators only install down-hole artificial lift equipment in the vertical portion of the wellbore. However, downhole pump systems and compressed gas lift systems are not designed to recover any liquids that exist below the down-hole equipment. In many directional and horizontal wells, a column of liquid ranging from 300 to many thousands of feet may exist below the down-hole equipment installed in the vertical portion of the wellbore. Because of this condition considerable hydrocarbons reserves cannot be recovered using conventional methods in depletion or partial depletion drive directional or horizontally drilled wells. Thus, a major problem with the current technology is that reservoir liquids located below conventional down-hole artificial lift equipment cannot be lifted.

Therefore, one object of the present invention is to provide an artificial lift system that will enable the recovery of liquids in the deviated sections of directional or horizontal wellbores.

It is also an object of the present invention to lower the artificial lift point from the vertical wellbore section into the deviated section.

It is also an object of the present invention to provide a high velocity volume of injection gas to more efficiently sweep the reservoir liquids from the wellbore.

A further object of the present invention is to provide a more efficient, less costly wellbore liquid removal process.

These and other objects of the present invention will become better understood with reference to the following specification and claims.

SUMMARY OF THE INVENTION

A gas assisted downhole pump is disclosed, which is an artificial lift system designed to recover by-passed hydrocarbons in directional and horizontal wellbores by incorporating a dual tubing arrangement in which each string contains (respectively) a downhole pumping system or a gas lift system. In one string, a gas lift system (preferably intermittent) is utilized to lift reservoir fluids below the downhole pump to above a packer assembly where the fluids become trapped. As more reservoir fluids are added above the packer, the fluid level rises in the casing annulus above the downhole pump (which is installed in the adjacent string), and the trapped reservoir fluids are pumped to the surface by the downhole pump.

BRIEF DESCRIPTION OF THE DRAWINGS

For a further understanding of the nature and objects of the present invention, reference is had to the following figures in which like parts are given like reference numerals and wherein.

DETAILED DESCRIPTION OF THE PREFERRED EMBODIMENTS

Figure 1:
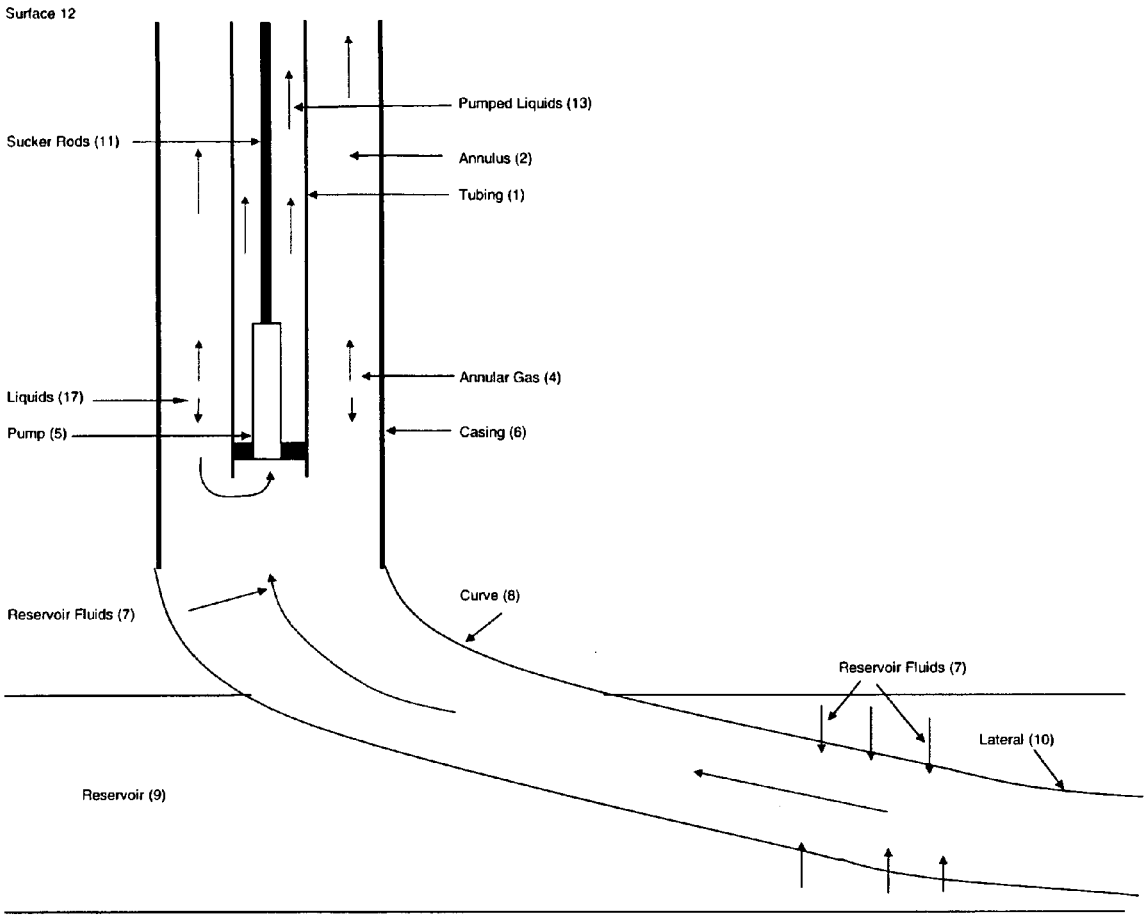
FIG. 1 depicts a directional or horizontal wellbore installed with a conventional rod pumping system of the prior art.

FIG. 1 shows one example of a conventional rod pump system of the prior art in a directional or horizontal wellbore. As set out in FIG. 1, tubing 1, which contains pumped liquids 13 is mounted inside a casing 6. A pump 5 is connected at the end of tubing 1 nearest the reservoir 9. Sucker rods 11 are connected from the top of pump 5 and continue vertically to the surface 12. Casing 6, cylindrical in shape, surrounds and is coaxial with tubing 1 and extends below tubing 1 and pump 5 on one end and extends vertically to surface 12 on the other end. Below casing 6 is curve 8 and lateral 10 which is drilled through reservoir 9. The process is as follows: reservoir fluids 7 are produced from reservoir 9 and enter lateral 10, rise up curve 8 and casing 6. Because reservoir fluids 7 are usually multiphase, it separates into annular gas 4 and liquids 17. Annular gas 4 emanates from reservoir fluids 7 and rises in annulus 2, which is the void space formed between tubing 1 and casing 6. The annular gas 4 continues to rise up annulus 2 and then flows out of the well to the surface 12. Liquids 17 enter pump 5 by the force of gravity from the weight of liquids 17 above pump 5 and enter pump 5 to become pumped liquids 13 which travel up tubing 1 to the surface 12. Pump 5 is not considered to be limiting, but may be any down-hole pump or pumping system, such as a progressive cavity, jet pump, or electric submersible, and the like.

Figure 2:
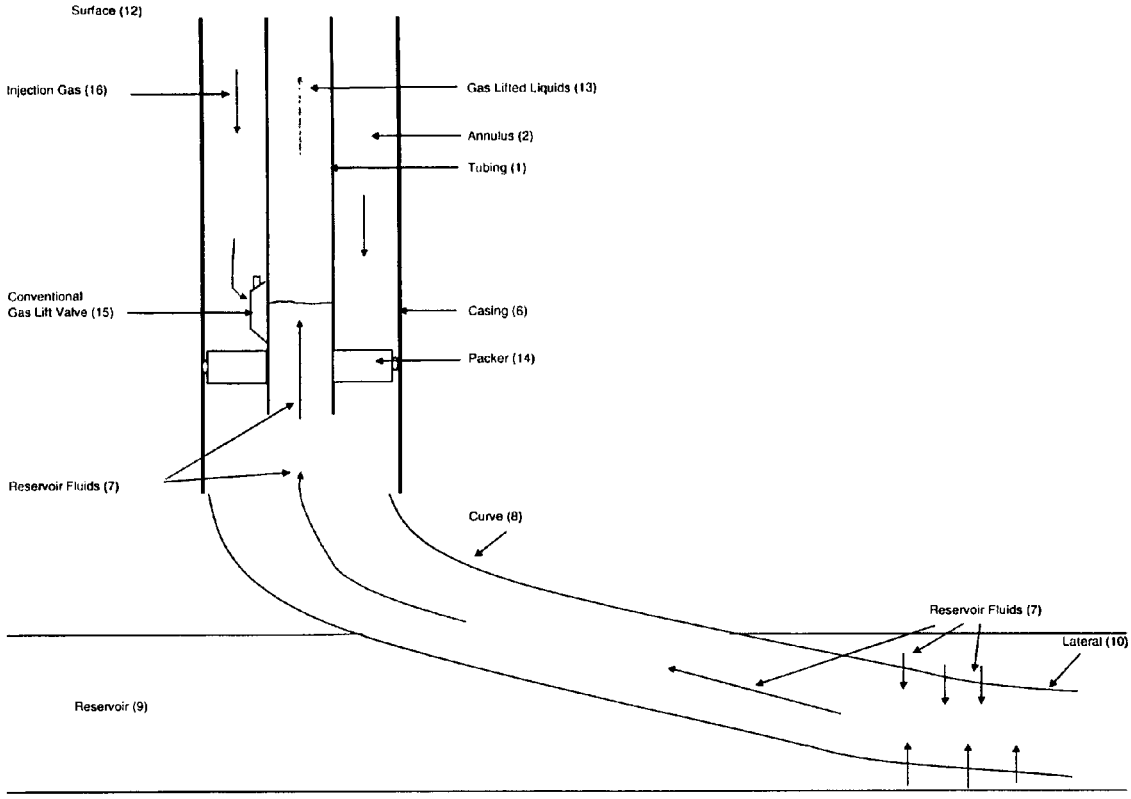
FIG. 2 depicts a conventional gas lift system in a directional or horizontal wellbore of the prior art.

FIG. 2 shows one example of a conventional gas lift system of the prior art in a directional or horizontal wellbore. Referring to FIG. 2, inside the casing 6, is tubing 1 connected to packer 14 and conventional gas lift valve 15. Below casing 6 is curve 8 and lateral 10 which is drilled through reservoir 9. The process is as follows: reservoir fluids 7 from reservoir 9 enter lateral 10 and rise up curve 8 and casing 6 and enter tubing 1. The packer 14 provides pressure isolation which allows annulus 2, which is formed by the void space between casing 6 and tubing 1, to increase in pressure from the injection of injection gas 16. Once the pressure increases sufficiently in annulus 2, the conventional gas lift valve 15 opens and allows the injection gas 16 to pass from the annulus 2 into the tubing 1, which then commingles with the reservoir fluids 7 to become gas lifted liquids 13. This lightens the fluid column and the gas lifted liquids 13 rise up the tubing 1 and then flow out of the well to the surface 12.

Figure 3:
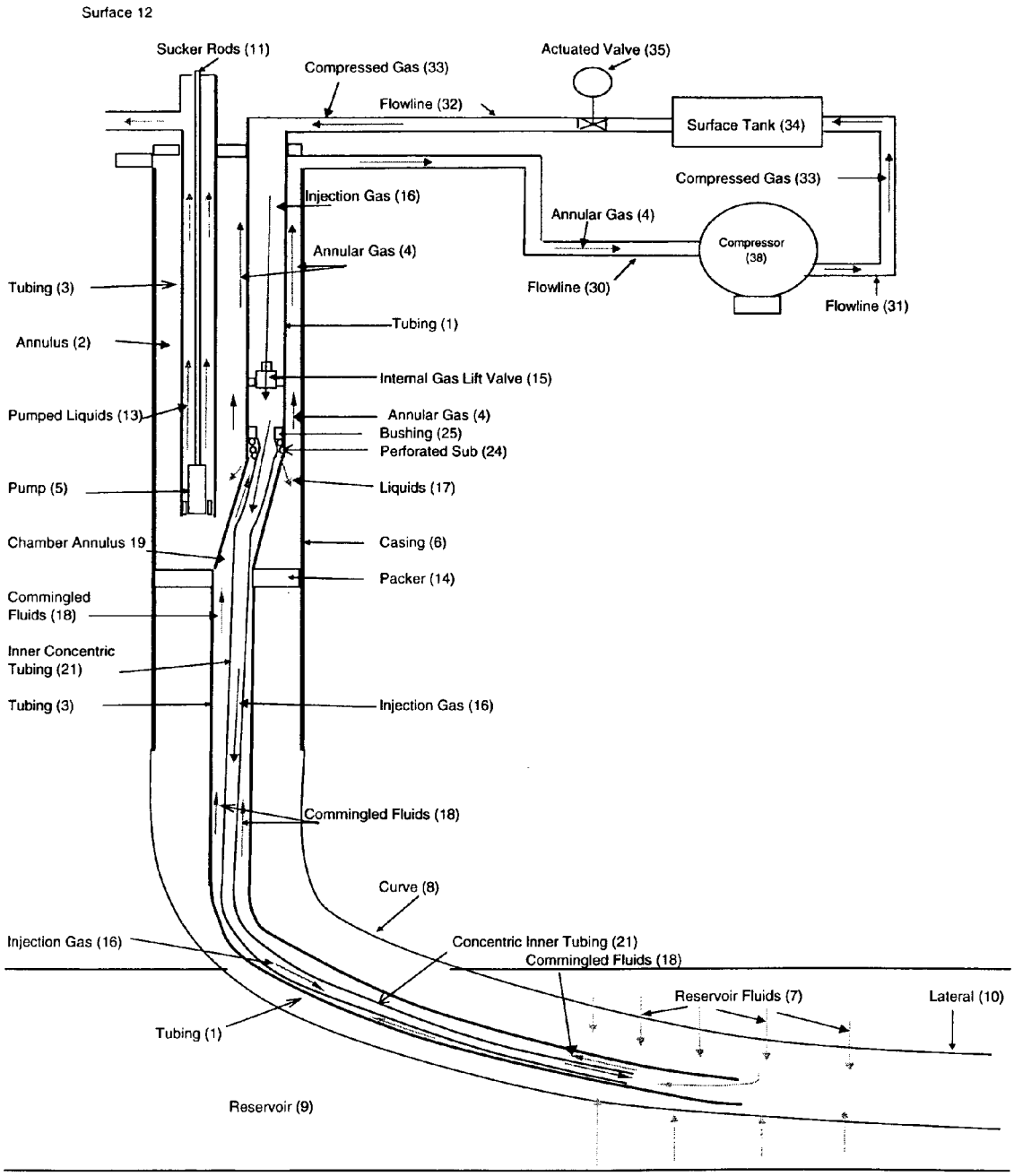
FIG. 3 depicts one version of the invention utilizing a rod pump and a gas lift system.

FIG. 3 shows the preferred embodiment of the invention utilizing a downhole pump and a gas lift system in a horizontal or deviated wellbore. Referring to FIG. 3, inside casing 6, is tubing 1 which begins at the surface 12 and contains internal gas lift valve 15, bushing 25, and inner concentric tubing 21. Tubing 1 is sealingly engaged to packer 14. Tubing 1 and inner concentric tubing 21, extend below packer 14 through curve 8 and into lateral 10, which is drilled though reservoir 9. Inside casing 6 and adjacent to tubing 1 is tubing 3 which contains pump 5 and sucker rods 11. Tubing 3 is not sealingly engaged to packer 14. The process is as follows: reservoir fluids 7 enter lateral 10 and rise up curve 8 and enter tubing 1. The reservoir fluids 7 are commingled with injection gas 16 to become commingled fluids 18 which rise up chamber annulus 19, which is the void space formed between inner concentric tubing 21 and tubing 1. The commingled fluids 18 then exit through holes in perforated sub 24. Annular gas 4 separates from commingled fluids 18 and rise in annulus 2, which is formed by the void space between casing 6 and tubing 1 and tubing 3. Annular gas 4 then enters flowline 30 at the surface 12 and enters compressor 38 to become compressed gas 33, and travels through flowline 31 to surface tank 34. The compressor 38 is not considered to be limiting, in that it is not crucial to the design if another source of pressured gas is available, such as pressured gas from a pipeline. Compressed gas 33 then travels through flowline 32 which is connected to actuated valve 35. This actuated valve 35 opens and closes depending on either time or pressure realized in surface tank 34. When actuated valve 35 opens, compressed gas 33 flows through actuated valve 35 and travels through flowline 32 and into tubing 1 to become injection gas 16. The injection gas 16 travels down tubing 1 to internal gas lift valve 15, which is normally closed thereby preventing the flow of injection gas 16 down tubing 1. A sufficiently high pressure in tubing 1 above internal gas lift valve 15 opens internal gas lift valve 15 and allows the passage of injection gas 16 through internal gas lift valve 15. The injection gas 16 then enters the inner concentric tubing 21, and eventually commingles with reservoir fluids 7 to become commingled fluids 18, and the process begins again. The liquids 17 separate from the commingled fluids 18 and fall in annulus 2 and are trapped above packer 14. As more liquids 17 are added to the annulus 2, liquids 17 rise above and are gravity fed into pump 5 to become pumped liquids 13 which travel up tubing 3 to the surface 12.

Figure 4:
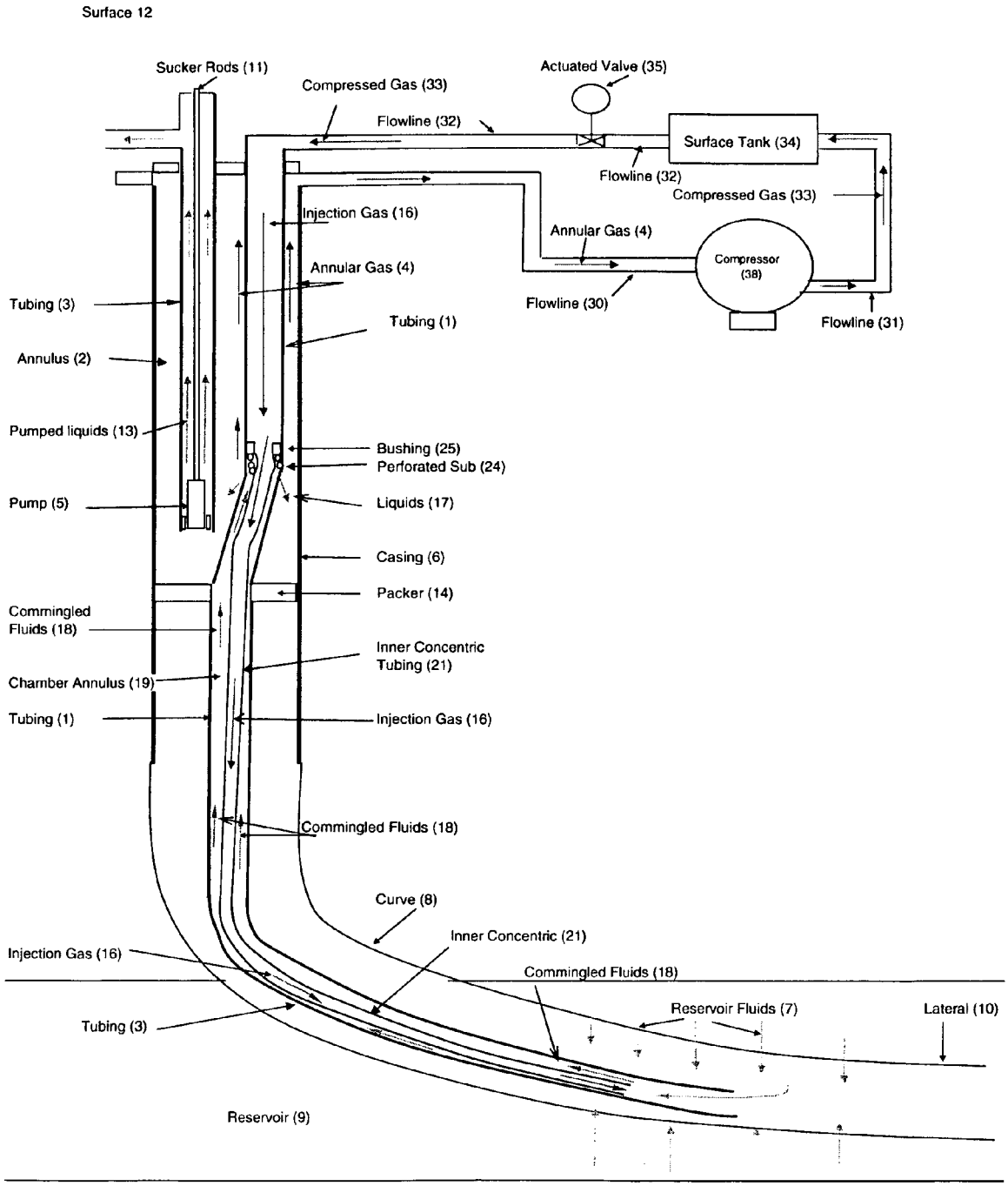
FIG. 4 depicts another embodiment of the invention similar to FIG. 3.

FIG. 4 shows an alternate embodiment of the invention similar to the design in FIG. 3 except that it does not utilize the internal gas lift valve 15.

Figure 5:
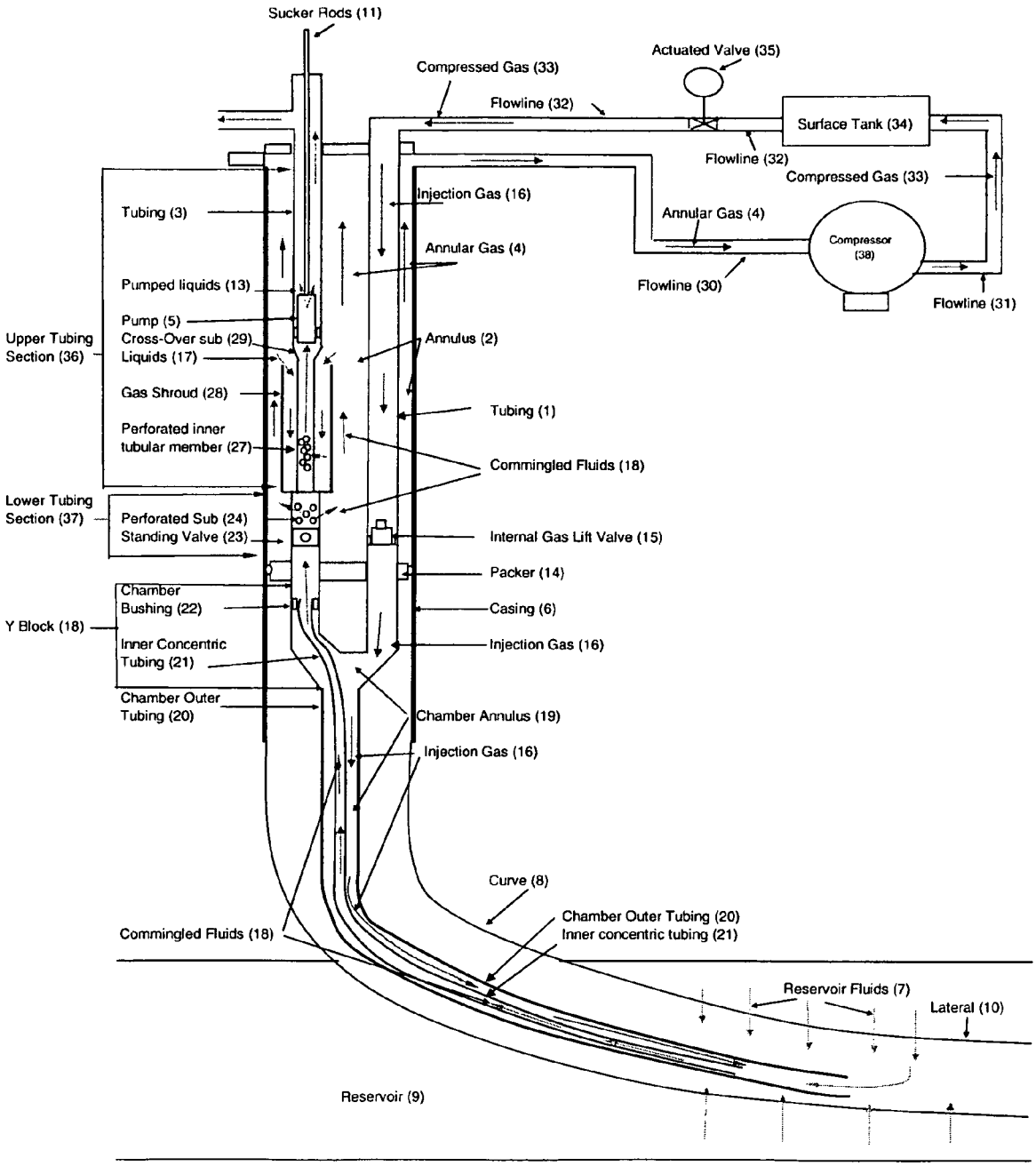
FIG. 5 depicts yet another embodiment of the invention similar to the FIG. 3, but with a different downhole configuration.

FIG. 5 shows yet another alternate embodiment of the invention utilizing a downhole pump and a gas lift system in a horizontal or deviated wellbore with a different downhole configuration from FIG. 3. Referring to FIG. 5, inside the casing 6, is tubing 1 which contains an internal gas lift valve 15 and is sealingly engaged to packer 14. Packer 14 is preferably a dual packer assembly and is connected to Y block 18 which in turn is connected to chamber outer tubing 20. Chamber outer tubing 20 continues below casing 6 through curve 8 and into lateral 10 which is drilled through reservoir 9. Inner concentric tubing 21 is secured by chamber bushing 22 to one of the tubular members of Y Block 18 leading to lower tubing section 37. The inner concentric tubing 21 extends inside of Y block 18 and outer chamber tubing 20 through the curve 8 and into the lateral 10. The second tubing string arrangement comprises a lower section 37 and an upper section 36. The lower section 37 comprises a perforated sub 24 connected above standing valve 23 and is then sealingly engaged in the packer 14. Perforated sub 24 is closed at its upper end and is connected to the upper tubing section 36. Upper tubing section 36 comprises a gas shroud 28, a perforated inner tubular member 27, a cross over sub 29 and tubing 3 which contains pump 5 and sucker rods 11. The gas shroud 28 is tubular in shape and is closed at its lower end and open at its upper end. It surrounds perforated inner tubular member 27, which extends above gas shroud 28 to crossover sub 29 and connects to the tubing 3, which continues to the surface 12. Above the crossover sub 29, and contained inside of tubing 3 at its lower end, is pump 5 which is connected to sucker rods 11, which continue to the surface 12. Annular gas 4 travels up annulus 2 into flow-line 30 which is connected to compressor 38 which compresses annular gas 4 to become compressed gas 33. The compressor 38 is not considered to be limiting, in that it is not crucial to the design if another source of pressured gas is available, such as pressured gas from a pipeline. Compressed gas 33 flows through flow-line 31 to surface tank 34 which is connected to a second flowline 32 that is connected to actuated valve 35. This actuated valve 35 opens and closes depending on either time or pressure realized in surface tank 34. When actuated valve 35 opens, compressed gas 33 flows through actuated valve 35 and travels through flowline 32 and into tubing 1 to become injection gas 16. The injection gas 16 travels down tubing 1 to internal gas lift valve 15, which is normally closed thereby preventing the flow of injection gas 16 down tubing 1. A sufficiently high pressure in tubing 1 above internal gas lift valve 15 opens internal gas lift valve 15 and allows the passage of injection gas 16 through internal gas lift valve 15, through Y Block 18 and into chamber annulus 19, which is the void space between inner concentric tubing 21 and chamber outer tubing 20. Injection gas 16 is forced to flow down chamber annulus 19 since its upper end is isolated by chamber bushing 22. Injection gas 16 displaces the reservoir fluids 7 to become commingled fluids 18 which travel up the inner concentric tubing 21. Commingled fluids 18 travel out of inner concentric tubing 21 into one of the tubular members of Y Block 18, through packer 14 and standing valve 23, and then through the perforated sub 24 into annulus 2, where the gas separates and rises to become annular gas 4 to continue the cycle. The liquids 17 separate from the commingled fluids 18 and fall by the force of gravity and are trapped in annulus 2 above packer 14 and are prevented from flowing back into perforated sub 24 because of standing valve 23. As liquids 17 accumulate in annulus 2, they rise above pump 5 and are forced by gravity to enter inside of gas shroud 28 and into perforated sub 26 where they travel up inner tubular member 27 and cross-over sub 29 to enter pump 5 where they become pumped liquids 13 and are pumped up tubing 3 to the surface 12.

Figure 6:
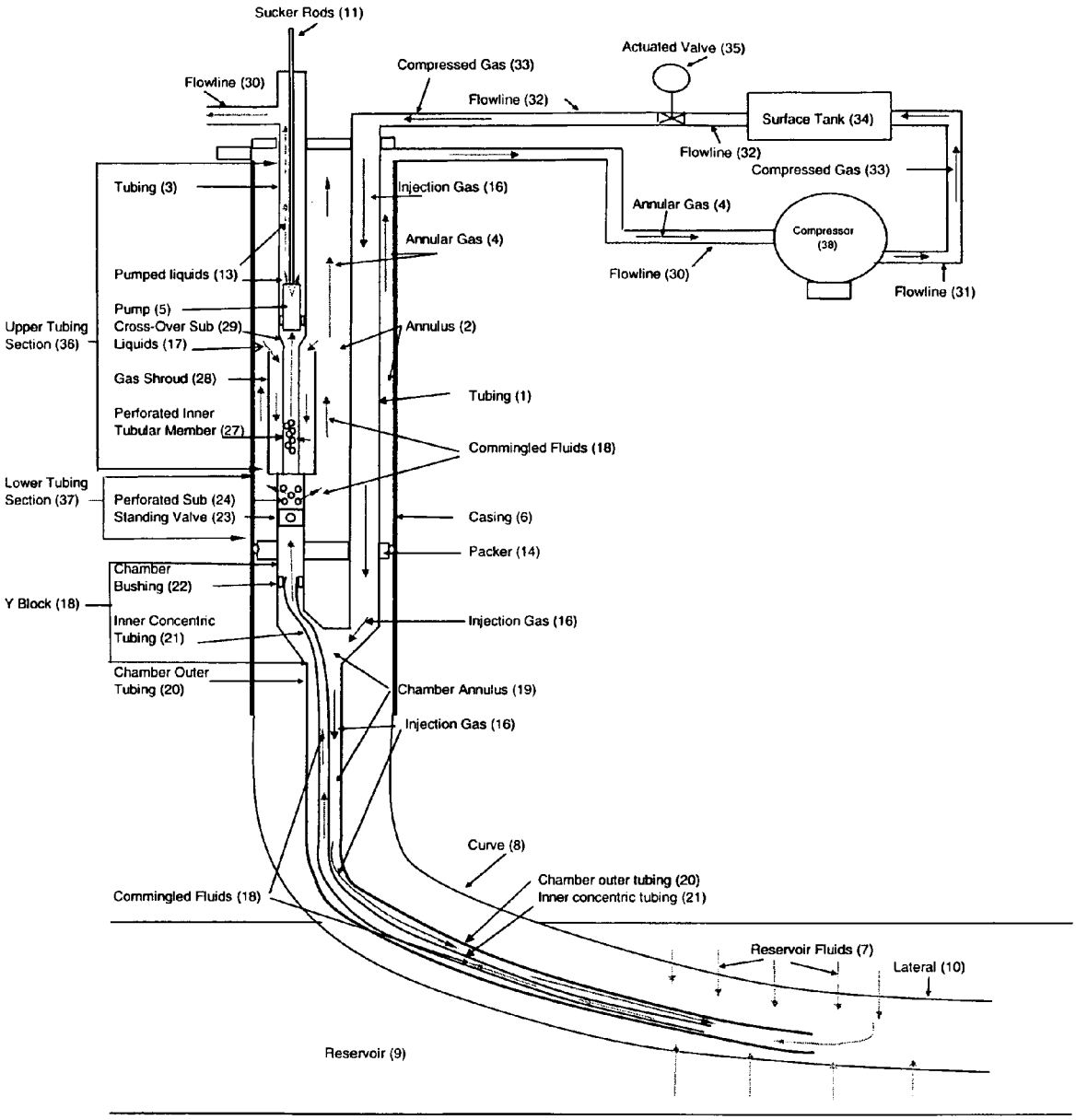
FIG. 6 depicts another embodiment of the invention similar to FIG. 5.

FIG. 6 shows an alternate embodiment of the invention similar to the design in FIG. 5 except that it does not utilize the internal gas lift valve 15.

As can be seen from the foregoing description of the preferred and alternate embodiments, the present invention is intended to provide an artificial lift system. Because many varying and difference embodiments may be made within the scope of the invention concept taught herein which may involve many modifications in the embodiments herein detailed in accordance with the descriptive requirements of the law, it is to be understood that the details herein are to be interpreted as illustrative and not in a limiting sense.

What is claimed is:

1. An artificial lift system in a wellbore extending from the surface to a reservoir having reservoir fluids, comprising:

a gas lift system including a first tubing string configured to inject a pressured gas from the surface through said first tubing string into the reservoir to commingle with and lift the reservoir fluids toward the surface through said first tubing string;

a packer;

a downhole system including a second tubing string adapted to pump reservoir fluids from said first tubing string to the surface; and a casing having said packer mounted therein, said casing surrounding said first tubing string and said second tubing string in the wellbore, wherein said first tubing string being sealingly engaged with said packer and configured to provide said pressured gas to commingle with and lift the reservoir fluids from below said packer to above said packer, and said second tubing string configured to pump the reservoir fluids above said packer to the surface, wherein a portion of said first tubing string contains an inner tubing string that has a first end nearest the surface and a second end farthest from the surface, wherein said inner tubing string is configured to move pressured gas from said first tubing string toward the reservoir, wherein said first tubing string and said inner tubing string extend through said packer, wherein said first end is located above said packer and below the surface, wherein said second end is located below said packer, wherein a space between the first tubing string and the inner tubing string forms an annulus configured to move the commingled pressured gas and reservoir fluids away from the reservoir while the pressured gas is moved toward the reservoir, wherein said first end is connected with said first tubing string with an annular isolation device configured to block said annulus, wherein said second end is in fluid communication with said annulus, and wherein said first tubing string comprises an opening below said annular isolation device and above said packer that is configured to allow communication between the wellbore and said annulus and the passing of the commingled pressured gas and reservoir fluids through said opening.

2. The artificial lift system of claim 1, wherein said gas lift system includes a gas flowline connected to said first tubing string, and a source of the pressured gas connects to a surface tank and said gas flowline contains a valve controlling the passage of the pressured gas into said first tubing string.

3. The artificial lift system of claim 1, wherein said first tubing string further includes an internal gas lift valve configured to prevent pressured gas from the surface from moving through said inner tubing string unless a pressure in said first tubing string exceeds a predetermined value.

4. The artificial lift system of claim 1, wherein said second tubing string contains a downhole pump configured to pump at the same time pressured gas is injected through said first tubing string.

5. The artificial lift system of claim 1, wherein there is included a compressor system connected to said gas lift system configured to introduce the pressured gas to said first tubing string and recirculate at least a portion of the pressured gas between the surface and the reservoir.

6. The artificial lift system of claim 5, wherein said gas lift system is configured to apply an intermittent back pressure on the reservoir.

7. The system of claim 1, wherein said annular isolation device is a bushing.

8. The system of claim 1, wherein said opening is in a perforated sub.

9. The system of claim 1, wherein said second end is located in the reservoir.

10. The system of claim 1, wherein said second tubing string has an end in the wellbore, and wherein said opening is located adjacent to said second tubing string end.

11. An artificial lift system for use in a deviated wellbore extending from the surface into the earth and having reservoir fluids and a pressured gas source, comprising:

a casing in the wellbore;

a gas lift system configured to inject a pressured gas from the surface through a first tubing string to commingle with and lift the reservoir fluids toward the surface in said first tubing string;

a downhole pump adapted to pump reservoir fluids from said first tubing string through a second tubing string to the surface; and a packer disposed between said first tubing string and said casing, wherein said first tubing string extending through said packer and said second tubing string not extending through said packer;

wherein a portion of said first tubing string contains an inner tubing string that has a first end nearest the surface and a second end farthest from the surface, wherein said inner tubing string is configured to move pressured as said first tubing string toward the reservoir, wherein said inner tubing string extends through said packer, wherein said first end is located above said packer and below the surface, wherein said second end is located in the reservoir, wherein a space between the first tubing string and the inner tubing string forms an annulus configured to move the commingled pressured gas and reservoir fluids away from the reservoir while the pressured gas is moved toward the reservoir, wherein said first end is connected with said first tubing string with a bushing configured to block said annulus, wherein said second end is in fluid communication with said annulus, and wherein said first tubing string comprises an opening below said bushing and above said packer that is configured to allow communication between the wellbore and said annulus and the passing of the commingled pressured gas and reservoir fluids through said opening.

12. The artificial lift system of claim 11, wherein said gas lift system is configured to recirculate at least a portion of the pressured gas between the surface and a reservoir.

13. The system of claim 11, wherein said opening is in a perforated sub.

14. The system of claim 11, wherein said second tubing string has an end in the wellbore, and wherein said opening is located adjacent to said second tubing string end.

15. A method for producing a reservoir fluid including reservoir liquid from a deviated wellbore originating at the earth's surface, comprising the steps of:

injecting a pressured gas from the surface through a first portion of a first tubing string extending from the surface into the wellbore and then through a second portion of the first tubing string extending through a packer disposed in a casing into the reservoir, wherein said second portion of the first tubing string contains an inner tubing string having a first end that is in the wellbore above said packer and below the surface and a second end that is in the reservoir;

moving the pressured gas through the inner tubing string after moving the pressured gas through said first portion of the first tubing string, isolating a second tubing string from the reservoir with said packer;

commingling the pressured gas with the reservoir fluid to be lifted;

lifting the commingled pressured gas and reservoir fluid through an annulus between the first tubing string and the inner tubing string and through the packer away from the reservoir using the pressured gas while the pressured gas is simultaneously moved through the inner tubing string toward the reservoir;

blocking the commingled pressured gas and reservoir fluid in said annulus above said packer and below the surface;

redirecting the blocked commingled pressured gas and reservoir fluid through an opening located in the first tubing string above said packer and below the surface that allows communication between the wellbore and said annulus;

separating the pressured gas and reservoir liquid above the packer and in the wellbore; and pumping the reservoir liquid from the first tubing string to the surface through the second tubing string during the step of injecting.

16. The method of claim 15, further comprising the step of:

recirculating at least some of the pressured gas back through said first tubing string from the surface into the wellbore.

17. The method of claim 15, wherein said first end of the inner tubing string is connected with the first tubing string above the packer and below the surface with an annular isolation device.

18. The method of claim 17, wherein said annular isolation device is a bushing.

19. The method of claim 18, wherein said step of blocking is performed with said bushing.

20. The method of claim 19, wherein said opening is in a perforated sub.

21. The system of claim 19, wherein said second tubing string has an end in the wellbore, and wherein said opening is located adjacent to said second tubing string end.

22. The method of claim 19, wherein said step of pumping is performed with a downhole pump.

23. The method of claim 22, wherein said opening is adjacent to said downhole pump.

* * * * *

UNITED STATES PATENT AND TRADEMARK OFFICE

CERTIFICATE OF CORRECTION

PATENT NO. : 8,006,756 B2
APPLICATION NO. : 12/001152
DATED : August 30, 2011
INVENTOR(S) : Daryl V. Mazzanti It is certified that error appears in the above-identified patent and that said Letters Patent is hereby corrected as shown below:

In the Claims

In Claim 11, Column 7, Line 9, "as" should be changed to --gas-- and --from-- should be entered between "gas" and "said".

In Claim 15, Column 8, Line 20, --and-- should be inserted after "annulus;".

In Claim 21, Column 8, Line 40, "system" should be changed to --method--.

Signed and Sealed this
Thirtieth Day of June, 2015

Michelle K. Lee

Michelle K. Lee
*Director of the United States Patent and Trademark Office*